US005779226A

United States Patent [19]

Wudtke

[11] Patent Number: 5,779,226

[45] Date of Patent: Jul. 14, 1998

[54] ANCHORING SYSTEM

[76] Inventor: Donald J. Wudtke, 2681 Martin Rd., Mt. Vernon, Wash. 98273

[21] Appl. No.: 820,454

[22] Filed: Mar. 17, 1997

Related U.S. Application Data

[60] Provisional application No. 60/013,441 Mar. 15, 1996.

[51] Int. Cl.[6] ..... B63B 21/00; B66D 1/30

[52] U.S. Cl. ..... 254/278; 114/293; 242/602.2; 242/603; 254/374

[58] Field of Search ..... 254/278, 374; 242/602.2, 603; 114/293

[56] References Cited

U.S. PATENT DOCUMENTS

| | | | |
|---|---|---|---|
| 1,621,714 | 3/1927 | Dyer et al. | 242/603 |
| 1,689,016 | 10/1928 | Erlewine | 242/603 |
| 2,212,798 | 8/1940 | Sole . | |
| 3,842,776 | 10/1974 | Wudtke . | |
| 3,960,340 | 6/1976 | Naas . | |
| 3,967,572 | 7/1976 | Lea . | |
| 3,985,093 | 10/1976 | Eidem | 114/293 |
| 4,020,779 | 5/1977 | Kitt . | |
| 4,078,768 | 3/1978 | Krogstad et al. . | |
| 4,722,293 | 2/1988 | Foster et al. . | |
| 4,841,898 | 6/1989 | Ballantyne . | |
| 5,522,336 | 6/1996 | Fujita . | |

FOREIGN PATENT DOCUMENTS

0612655A2 8/1994 European Pat. Off. .

*Primary Examiner*—Katherine Matecki
*Attorney, Agent, or Firm*—J. Robert Cassidy

[57] ABSTRACT

A composite storage winch for use in the deployment and retrieval of anchor systems employed with motive offshore drilling platforms. The stowage winch includes: i) a pair or spaced apart pedestals on the drilling platform; ii) a drive shaft journaled in the pedestals; iii) first and second storage drums coaxially mounted on the drive shaft, the first storage drum having a diameter substantially less than that of the second storage drum; iv) a central circular flange having a diameter substantially greater than that of the second storage drum secured intermediate the first and second storage drums; v) second and third circular flanges having diameters substantially equal to the central flange and secured to the ends of the first and second drums; vi) a wire support groove extending from the outer peripheral edge of the sidewall on the central flange facing the second drum downwardly through the central flange tangentially with respect to the first drum and exiting from the central flange adjacent the first drum; vii) a wire rope lanyard having inboard and outboard ends with the inboard end fixedly secured to the second drum; viii) a wire mooring rope having inboard and outboard ends wound about the first drum with the inboard end extending through the wire support groove and being separably secured to the outboard end of the wire rope lanyard by a separable connector; and ix), a source of mobile power coupled to the drive shaft for rotation thereof.

7 Claims, 10 Drawing Sheets

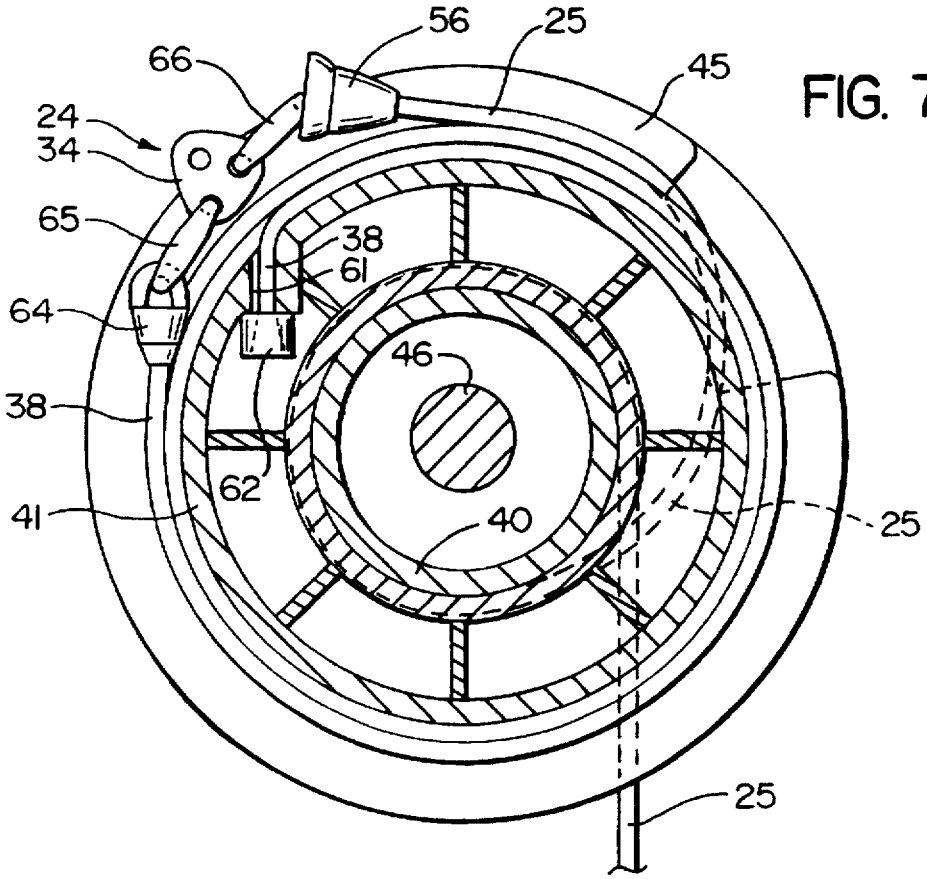
FIG. 7
FIG. 8
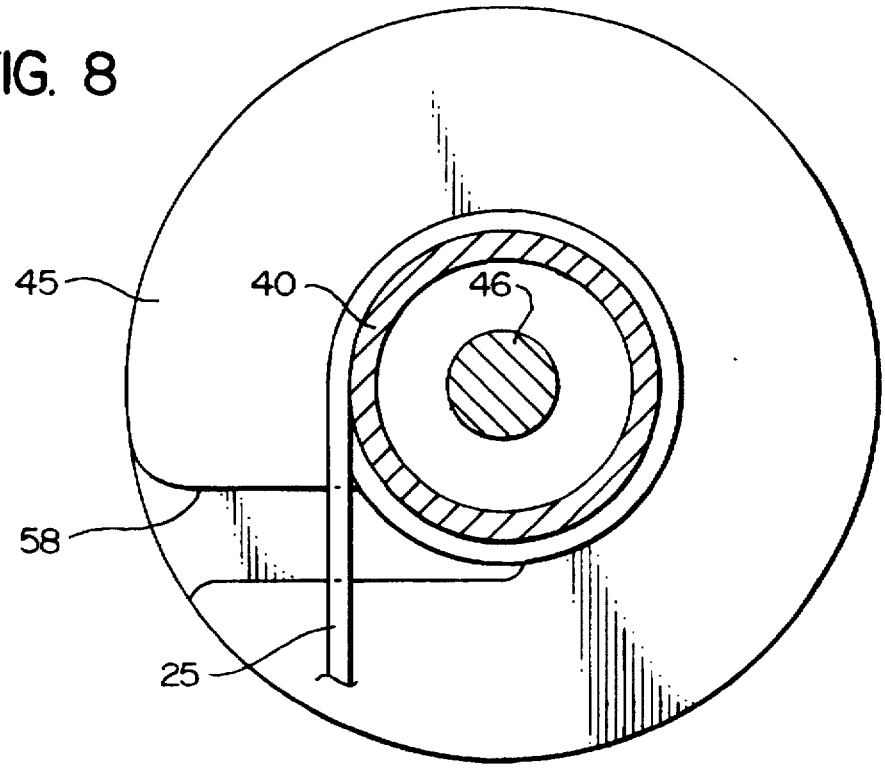

ANCHORING SYSTEM

RELATED APPLICATION

This application is based on, and is a continuation-in-part of, Applicant's co-pending Provisional Patent Application No. 60/013,441 filed Mar. 15, 1996.

BACKGROUND OF THE INVENTION

A. Technical Field

The present invention relates generally to an anchoring system suitable for use with mobile offshore drilling platforms; and, more particularly, an anchoring system of the foregoing type wherein each anchor, when deployed, is disposed at the outboard end of a chain/wire mooring rope/chain combination wherein the inboard and outboard chain segments are separably connected to an intermediate wire mooring rope adapted to be fully submerged—i.e., positioned out of the splash zone—when the anchor is deployed. In its principal form, the invention relates to an improved dual drum storage winch, capable of: i) storing and unreeling both the wire mooring rope and a wire rope lanyard designed to enable and facilitate ease of connection of the wire mooring rope successively to both the outboard and inboard chain sections as the chain sections are withdrawn from the anchor chain locker and the anchor is deployed; and ii), reeling in and storing both the wire mooring rope and the wire rope lanyard during that period of time when the anchor and anchor chain are being reeled on-board with the dual drum storage winch and lanyard enabling and facilitating disconnection of the wire rope lanyard from the wire mooring rope when the latter is respooled and stored, and reconnection of the inboard and outboard chain segments as the anchor chain is pulled inboard and returned to the chain locker.

B. Background Art

Structures such as offshore drilling rigs or platforms are located at various locations in the ocean where they may be exposed to heavy seas. It is necessary for such structures to be firmly anchored to avoid excessive lateral drift relative to the associated drilling structure. The anchoring structure commonly used has consisted of a substantial number of conventional anchors having flukes which dig into the bottom and are attached to the rig by a length of chain. Because of the weight of the chain relative to its strength, this type of attachment system has limited the depth of such installations to about 1,500 feet. Wire rope has better characteristics with respect to strength per unit length, but does not, alone, form a good suspension system for an anchor of the type referred to above because it tends to impose upward forces on the anchor when loaded.

One type of suspension system—i.e., a chain/wire rope suspension system—includes a length of chain attached to the anchor combined with a length of wire rope—typically the wire rope will be approximately 3½" in diameter and will have a length of up to 6,000 feet. The wire rope is wound on a winch drum; and, the chain is disconnected from the wire rope and connected to the tag or rig chain that leads to the chain locker. The chain is then reeled in by means of a windlass and is stored in the chain locker. The mooring line guide fairlead located on the lower portion of the rig must handle the chain, wire rope and the wire rope connector as shown in Wudtke U.S. Pat. No. 3,842,776. This arrangement extends the working water depth to on the order of 5,000 feet.

The foregoing arrangement places the wire rope portion of the mooring line in the fairlead when the drilling rig is anchored on location. This subjects the wire rope to bending around the sheave and also to fatigue cycles due to the heave and pitch motions of the vessel; and, this reduces the useful life of the wire rope. The wire rope also passes through the splash zone—i.e., the transition region from underwater to above water. The splash zone is a very corrosive environment—e.g., an environment wherein maximum accumulation of corrosive elements from the salt water is combined with maximum oxygen content from the air—and, this further reduces the strength and useful life of the wire rope. Moreover, because of the multiple-strand construction of the wire rope, it is inherently difficult to assess the physical condition of the inner wire rope strands to determine if and when the wire rope must be taken out of service. This arrangement also requires: i) the wire rope winch to be of a heavy duty type capable of supporting the full mooring loads; and ii), the fairlead to be of the combination type.

One approach toward eliminating the foregoing problems is to use a chain/wire rope/chain mooring line arrangement that places the chain in the fairlead and the wire rope outboard of the fairlead. This eliminates the bends in the wire rope and places the entire wire rope portion of the mooring line underwater when the anchor is deployed—i.e., out of the corrosive splash zone—while retaining all of the desirable mooring characteristics of the combination chain/wire rope system. The full mooring loads are supported by the anchor windlass and not the storage winch for the wire rope. Because the wire rope storage winch is only required to deploy, retrieve and store the wire rope, it can be a light duty winch.

Drilling rigs equipped with all chain mooring systems have used the chain/wire rope/chain arrangement by inserting a length of wire rope into the center of the chain length. The existing chain windlass supports the full mooring loads. The deployment and recovery of the mooring line requires at least one, and sometimes two, very large workboats to carry the anchor chain and wire rope and join it to the rig end of the chain. This arrangement is cumbersome and time consuming since each of the four corners of the drilling platform may be tied down with three such structures making a total of twelve to be so recovered before the rig can be moved.

SUMMARY OF THE INVENTION

The present invention provides an improved dual drum storage winch which overcomes all of the foregoing disadvantages inherent in the prior art, and which is suitable for reeling in, reeling out and storing both a wire rope lanyard and a wire rope mooring line, yet wherein the storage winch is of light duty construction. The light duty dual drum winch of the present invention includes a pair of coaxial side-by-side drums, one of which is dimensioned to accommodate up to approximately 6,000 feet of wire rope having a diameter of approximately 3½" while simultaneously withstanding lateral forces urged on the drum's side flanges, and the other of which is capable of storing up to approximately 175 feet of approximately 2½" diameter wire rope employed as a lanyard, with the wire rope mooring line being coupled to the outboard end of the lanyard and being fed through a wire support groove on the common sidewall flange between the two coaxial drums, which wire support groove does not denigrate the structural integrity of the common sidewall flange between the two side-by-side coaxial drums.

It is an object of the invention to provide a simpler, yet structurally sound dual storage winch capable of storing up to approximately 6,000 feet, or more, of wire rope mooring cable and up to approximately 175 feet of wire rope lanyard which are separably interconnectable, yet wherein the arrangement is such that there is little or no tendency for the wire rope defining the mooring line to bend or kink at the entrance to the combination connector socket and wherein the wire rope mooring line is smoothly reeled tangentially on to and/or from the wire rope mooring line storage drum while the wire rope lanyard and coupling mechanism are smoothly reeled tangentially on to and/or from the lanyard storage drum while the lanyard and mooring line are maintained under tension.

DESCRIPTION OF THE DRAWINGS

These and other objects and advantages of the present invention will become more readily apparent upon reading the following Detailed Description and upon reference to the attached drawings, in which:

FIG. 7 is a sectional view taken substantially along the line 7—7 in FIG. 6; and, FIG. 8 is a vertical sectional view taken substantially along the line 8—8 in FIG. 6.

Figure 1:
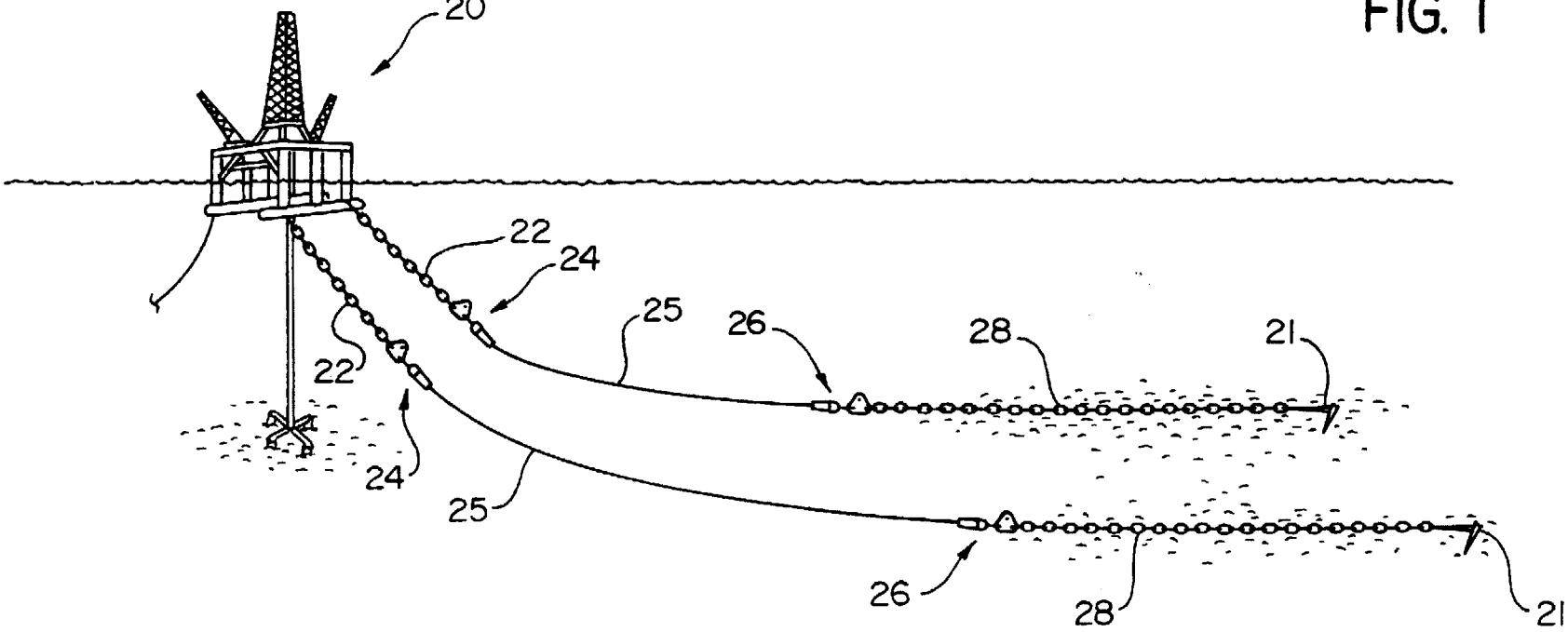
FIG. 1 is a highly diagrammatic, fragmentary, side elevational view here depicting a typical offshore drilling platform and anchoring system wherein only two mooring lines have been shown for purposes of clarity, although persons skilled in the art will appreciate that a total of eight or twelve mooring lines would normally be employed.

While the invention is susceptible of various modifications and alternative forms, specific embodiments thereof have been shown by way of example in the drawings and will herein be described in detail. It should be understood, however, that it is not intended to limit the invention to the particular forms disclosed; but, on the contrary, the intention is to cover all modifications, structural equivalents, equivalent structures, and/or alternatives falling within the spirit and scope of the invention as expressed in the appended claims. Thus, in the appended claims, means-plus function clauses and similar clauses are intended to cover: i) the structures described herein as performing a specific recited function; ii) structural equivalents thereof; and iii), equivalent structures thereto. For example, although a nail and a screw may not be deemed to be structural equivalents since a nail employs a cylindrical surface to secure wooden parts together while a screw employs a helical surface, in the art pertaining to fastening of wooden parts, a nail and a screw should be deemed to be equivalent structures since each perform the recited fastening function.

DETAILED DESCRIPTION

Turning now to the drawings, and directing attention first to FIG. 1, there has been illustrated in highly diagrammatic form, representative portions of an exemplary anchoring system suitable for use with a conventional mobile offshore drilling platform—an anchoring system with which the present invention finds particularly advantageous use. Thus, as here shown, a completely conventional mobile offshore drilling platform, generally indicated at 20, has been shown as anchored in place by means of fluked anchors 21 mounted on the outboard ends of chain/mooring wire rope/chain combinations, only two of which have been shown in detail for purposes of simplicity and clarity. Those skilled in the art will, however, appreciate that in a typical installation, multiple fluked anchors 21—e.g., eight or twelve anchors—will be connected to the platform 20 by chain/wire rope/chain combinations which radiate outboard from the drilling platform 20 in all directions so as to ensure that the platform remains stable irrespective of tidal, current, wind, and similar changing sea and/or environmental conditions.

In the illustrative anchoring system depicted in FIG. 1, each chain/wire rope/chain combination consists of: i) an inboard chain 22, commonly termed a "rig chain" or a "tag chain", having its inboard end fixedly connected to the drilling platform 20 structure; ii) a first inboard connector, generally indicated at 24, separably connected to the outboard end of the rig chain 22; iii) a wire mooring rope 25 having its inboard end separably connected to the first inboard connector 24 and, therefore, to the rig chain 22; iv) a second outboard connector, generally indicated at 26, separably connected to the outboard end of the wire mooring rope 25; v) an outboard chain 28, commonly termed an "anchor chain", having its inboard end separably connected to the second outboard connector 26; and vi), a fluked anchor 21 connected to the outboard end of the anchor chain 28. As those persons skilled in the art appreciate, each chain/wire rope/chain combination is extremely long—often on the order of 11,000 feet in aggregate length having a wire mooring rope 25 on the order of 6,000 feet in length and rig and anchor chains 22, 28 each on the order of 2,500 feet in length—and heavy, commonly weighing on the order of 582,000 pounds. Therefore, deployment of each fluted anchor 21 and subsequent retrieval thereof involves a series of labor intensive complex operations, particularly since the wire rope mooring line 25 must be disconnected from the chain/wire rope/chain combination during retrieval of the anchor 21 and stored separately from the chain. Moreover, during deployment each wire rope mooring line 25 must be reconnected to the anchor chain 28, unreeled and paid out, and reconnected to the rig chain 22. Such operations will be described in greater detail in connection with FIGS. 2A through 2E.

Figure 2A:
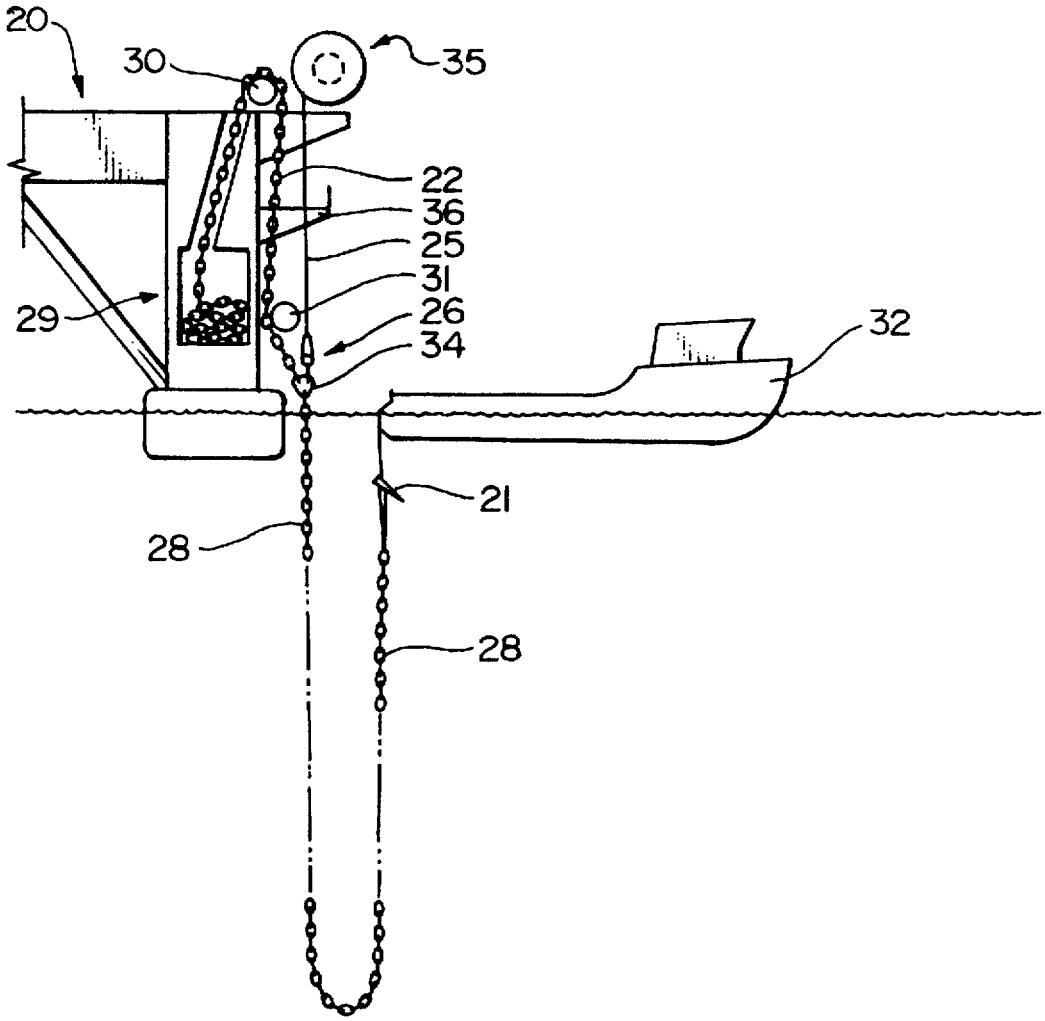
FIGS. 2A through 2E are highly diagrammatic, fragmentary, side elevational views here sequentially depicting the unreeling of an anchor chain, wire rope mooring line, wire rope lanyard and tag or rig end of the anchor chain in an anchoring process.

Thus, referring to FIG. 2A, it will be noted that at the outset of an anchor deployment operation, the anchor chain 28 and rig chain 22, which are initially separably coupled together by the second outboard connector 26, are partially paid out of the drilling platform's anchor chain locker, generally indicated at 29, by a conventional power driven windlass 30. As shown in FIG. 2A, the rig chain 22 is paid out sufficiently far so that the rig chain passes over a chain fairlead 31 with the second outboard connector 26 being disposed just above the water line, while the anchor chain 28 is suspended from the connector 26 in a U-shaped bight with the fluked anchor 21 being suspended from a separate workboat, generally indicated at 32. The exemplary outboard connector 26 includes a 3-eye link 34 with the outboard end of the rig chain 22 separably connected to one eye, and the inboard end of the anchor chain 28 separably connected to a second eye. As here shown, the wire mooring rope 25 is stored on a storage winch 35 located onboard the drilling platform 20, with the outboard end of the wire mooring rope 25 having been connected to the third eye of the 3-eye link 34 included in the second outboard connector 26.

In this exemplary form of an anchoring system embodying features of the invention, at least certain of the connections and disconnections between the second outboard connector 26 (and the first inboard connector 24 as shown in FIG. 1) and respective ones of the rig chain 22, wire mooring rope 25 and anchor chain 28 are made outboard of the chain fairlead 31 and, therefore, close to the water line. Consequently, the work necessary to form such connections and disconnections must be made either by crew members located on the separate workboat 32 or by suspending a worker in a basket (not shown) lowered to the water line from the drilling platform 20. Indeed, often such operations are sufficiently complex that crew members on a second workboat (not shown) will be required in order to make such connections/disconnections while the first workboat 31 is deploying or retrieving the anchor 21. In the exemplary anchor deployment operation depicted in FIG. 2A, the work crew has connected the outboard end of the wire mooring rope 25 to the third eye of the 3-eye link 34 which is in the second outboard connector 26; but, the outboard end of the rig chain 22 has not yet been disconnected from the 3-eye link.

Figure 2B:
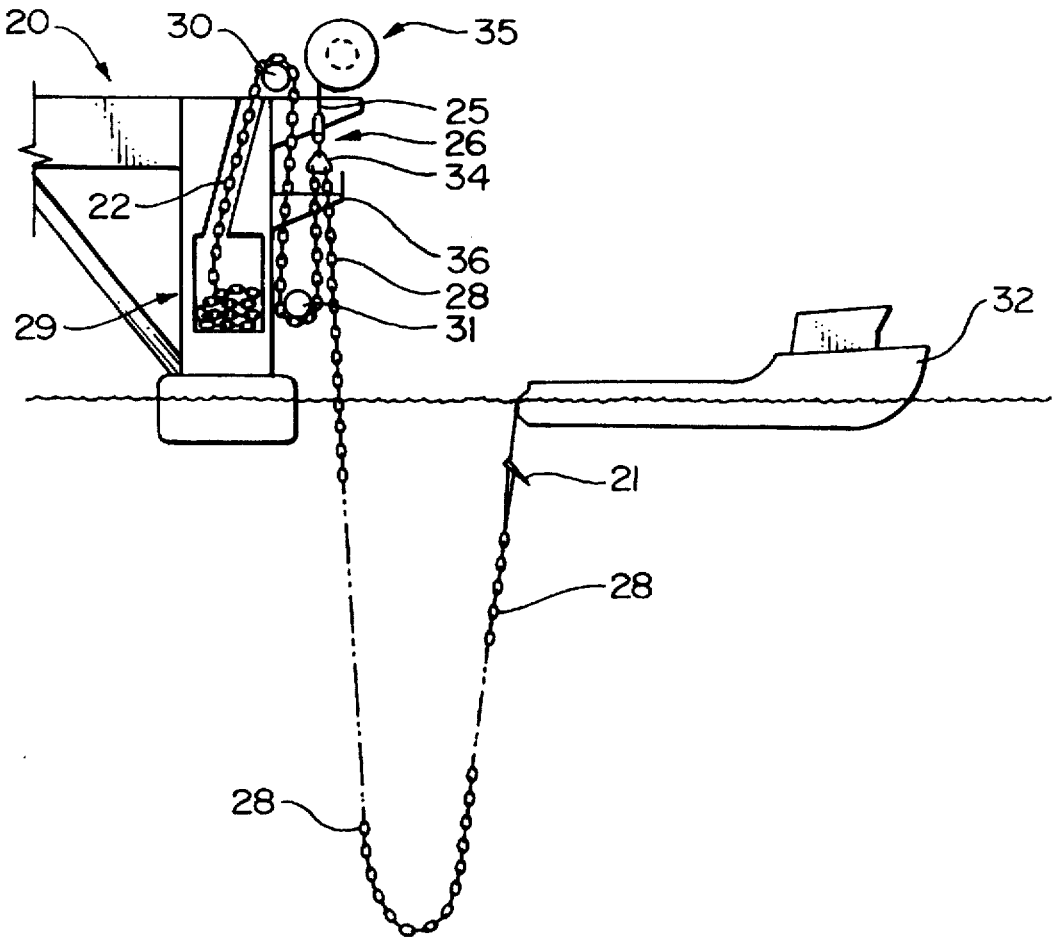

To disconnect the rig chain 22 from the 3-eye link 34 in the second outboard connector 26, the wire mooring rope 25 (which has only been partially paid out from the storage winch 35 of the present invention), is first reeled in slightly as shown in FIG. 2B so as to raise the second outboard connector 26 to a position where it is accessible to one or more workers (not shown) stationed on a work platform 36. At this point in the operation, the worker(s) disconnect the outboard end of the rig chain 22 from the second outboard connector 26; and, the wire mooring rope 25 is then paid fully out as shown in FIG. 2C with the workboat 32 carrying the fluked anchor 21, anchor chain 28 and outboard end of the wire mooring rope 25 outwardly away from the drilling platform 20.

Figure 2C:
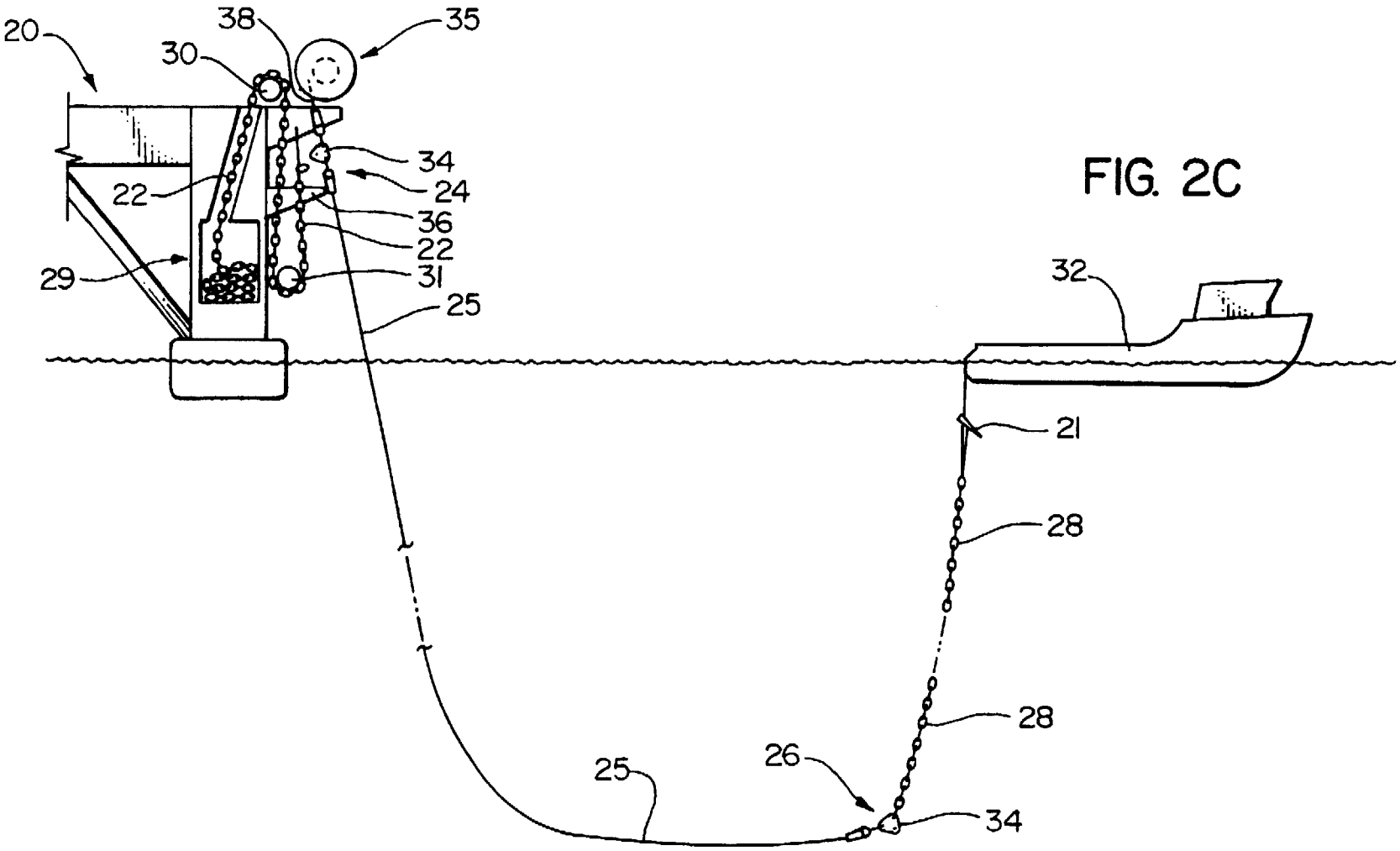
Figure 2D:
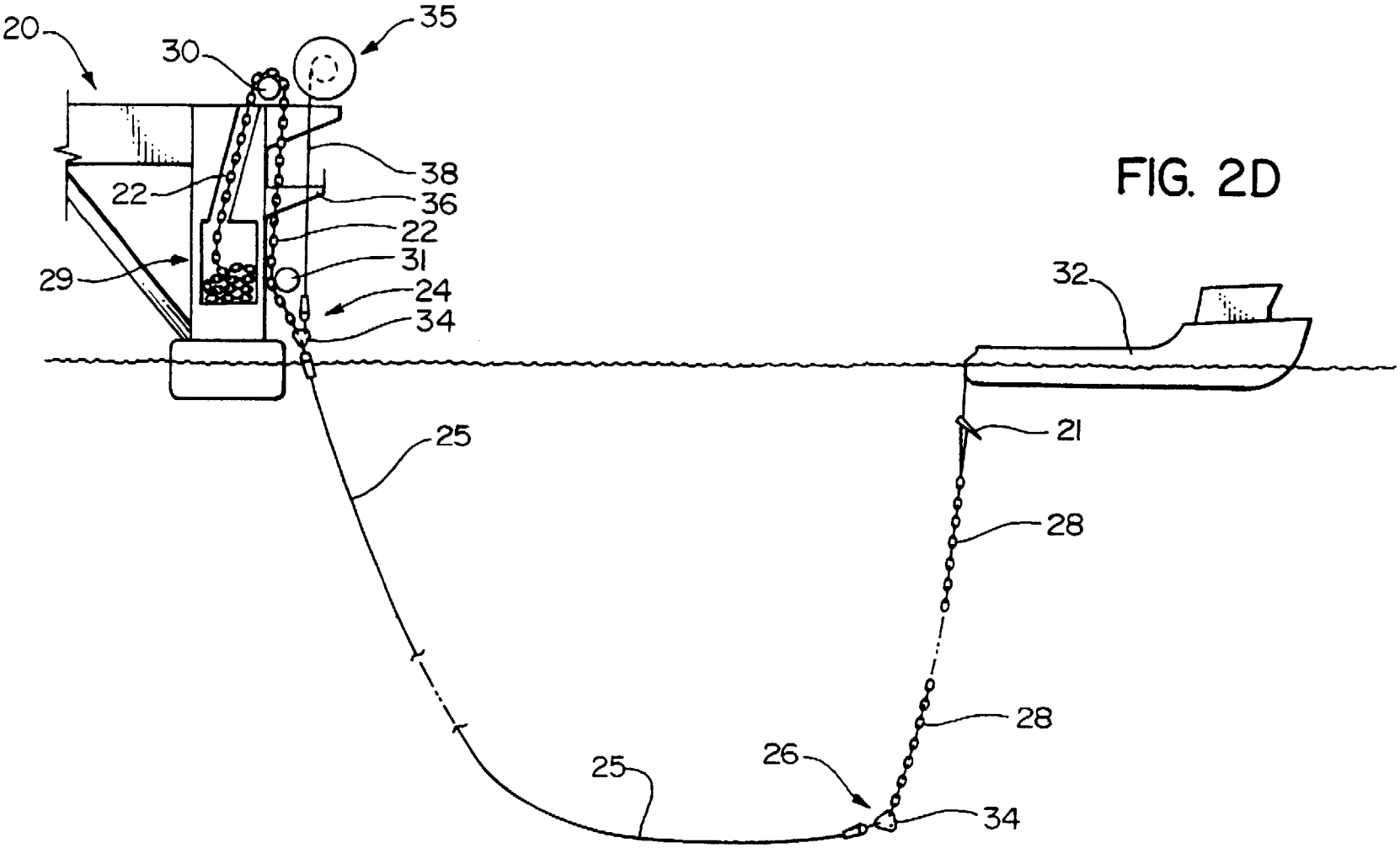
Figure 2E:
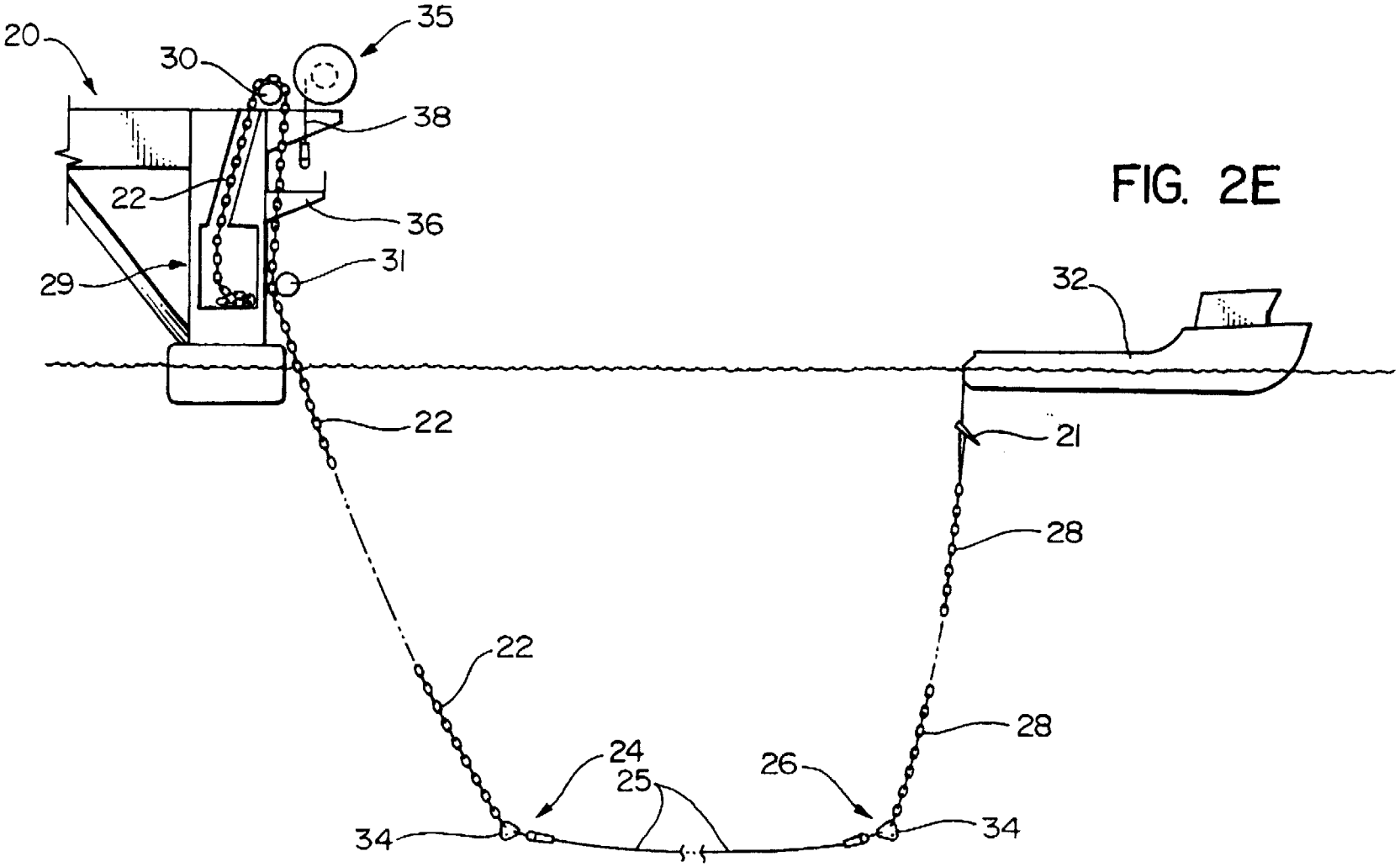

When the wire mooring rope 25 is fully unreeled from the storage winch 35 of the present invention, as shown in FIG. 2C, the first inboard connector 24, which separably couples the inboard end of the mooring rope 25 to the outboard end of a wire rope lanyard 38, is unreeled from the storage winch 35 and becomes accessible to the worker(s) (not shown) on the work platform 36. At this point, the worker(s) couple the outboard end of the rig chain 22 to the 3-eye link 34 in the first inboard connector 24. The lanyard 38 is then unreeled from the storage winch 35 so as to lower the outboard end of the rig chain 22 and the first inboard connector 24 to a point just above the surface of the water, as best shown in FIG. 2D. The weight of the wire rope mooring line 25 is now suspended from the rig chain 22 which is trained over the power driven windlass 30. Consequently, one or more crew members on a second workboat (not shown)—or, alternatively, a worker suspended in a basket (not shown) from the drilling platform 20—disconnect the wire rope lanyard 38 from the first inboard connector 24. The lanyard 38 is again reeled onto the storage winch 35, while the balance of the rig chain 22 is paid out from the anchor chain locker 29 by the windlass 30 as shown in FIG. 2E. When the chain/wire rope mooring line/chain combination is fully paid out as shown in FIG. 2E, the workboat 32 moves to a predetermined location and releases the fluked anchor 21.

Retrieval of the deployed anchor 21 and its associated chain/wire rope/chain combination is accomaplished by performing the foregoing operations in essentially the reverse order—i.e., the anchor 21 is retrieved and brought up to the workboat 32; the rig chain 22 is reeled in by the windlass 30 until the first inboard connector 24 is in the position shown in FIG. 2D; the lanyard 38 is reattached to the first inboard connector 24 by one or more crew members on a second workboat (not shown) or by a worker suspended from the drilling platform 20 in a basket (not shown); the lanyard 28 is then raised to lift the first inboard connector 24 to the level of the work platform 36; the rig chain 22 is disconnected from the first inboard connector 24; the wire mooring rope 25 is reeled onto the storage winch 35 until the second outboard connector 26 is accessible to one or more workers on the work platform 36; the outboard end of the rig chain 22 is reattached to the second outboard connector 26; the wire rope mooring line 25 is unreeled sufficiently far enough that the second outboard connector 26 is just above the water line where the weight of the anchor chain 28 is supported from the rig chain 22 and windlass 30 while the second outboard connector 26 remains accessible to crew members on one of the workboats 32; the wire mooring rope 25 is disconnected from the second outboard connector 26 and is re-reeled onto the storage winch 35 of the present invention; and, the rig chain 22, second outboard connector 26 and anchor chain 28 are reeled in by the power driven windlass, passed over the fairlead 31, and are restowed in the anchor chain locker 29.

Referring next to FIGS. 3A through 3D, a slightly modified anchor deployment/retrieval system has been depicted which is essentially the same as that described above except that the connection and/or disconnection of the wire mooring rope 25 to and from the second outboard connector 26, as well as the connection and/or disconnection of the lanyard 38 to and from the first inboard connector 24, are all performed inboard of the combination fairlead 31. Consequently, all connections can be made by one or more workers (not shown) standing on the work platform 36; no connections/disconnections need be made at the water line; and, therefore, no second workboat (or, alternatively, no worker lowered in a basket from the drilling platform 20) need be employed. This is accomplished using a modified combination fairlead 31 of the type described in the aforesaid Wudtke U.S. Pat. No. 3,842,776 which is capable of passing not only the rig chain 22, anchor chain 28 and inboard and outboard connectors 24, 26, but, also, the wire mooring rope 25 when the latter is attached to the outboard connector 26.

Figure 3A:
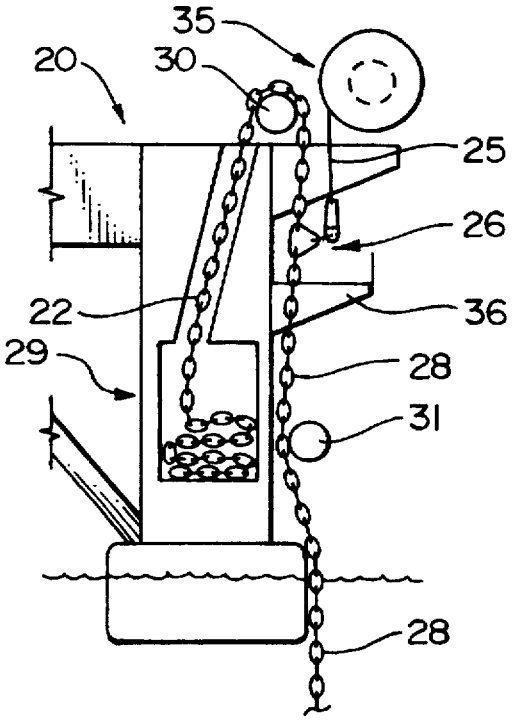
FIGS. 3A through 3D are highly diagrammatic, fragmentary, side elevational views, respectively corresponding to FIGS. 2A through 2D, here showing sequential stages of deployment for reeling out and reeling in an anchor chain employing a slightly modified system for handling the anchor chain, lanyard and wire rope mooring line.
Figure 3B:
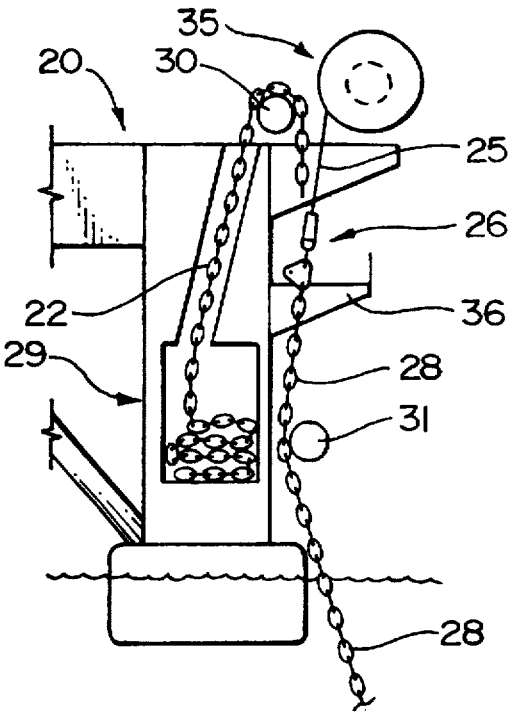
Figure 3C:
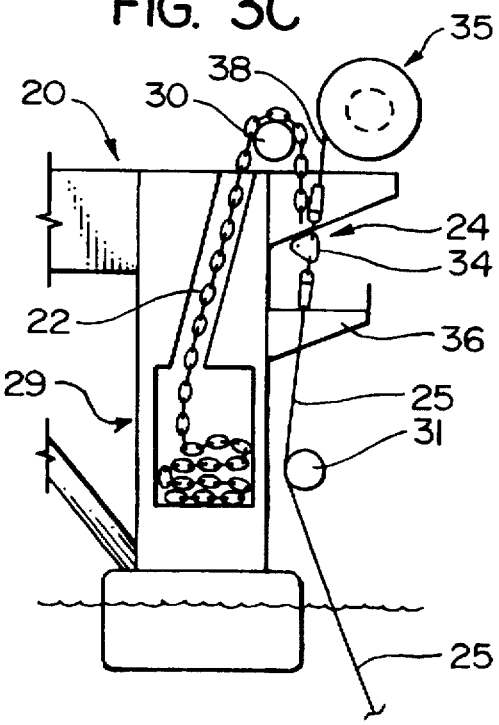
Figure 3D:
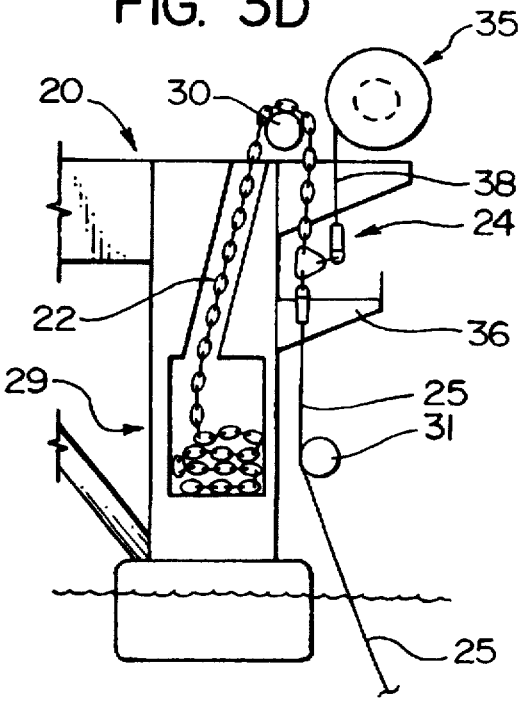

Thus, as shown in FIGS. 3A and 3B, the outboard end of the wire mooring rope 25 is connected to the second outboard connector 26 at the work platform 36 but inboard of the combination fairlead 31. The rig chain 22 is then disconnected from the second outboard connector 26; and, the anchor chain 28, wire mooring rope 25 and second outboard connector 26 are unreeled, passing over the combination fairlead 31. When the wire rope mooring line 25 is fully paid out as shown in FIG. 3C, the first inboard connector 24 is located at the work platform 36. Consequently, when the outboard end of the rig chain 22 has been connected to the first inboard connector 24, the lanyard 28 is paid out until all of the weight of the wire rope mooring line 25 is supported on the rig chain 22 and, therefore, on the windlass 30; and, lanyard 28 is disconnected from the first inboard connector 24 and re-reeled onto the storage winch 35 of the present invention, thus permitting the rig chain 22 and the wire mooring rope 25 to be paid out over the chain fairlead 31. Again, during retrieval of the anchor 21, the foregoing steps are repeated in reverse order.

In accordance with one of the important aspects of the present invention, the dual drum storage winch, generally indicated at 35 in FIGS. 2A through 2E and 3A through 3D, is configured with two coaxial, side-by-side storage drums 40, 41 of different diameters which are rotationally driven, in unison, in a first rotational direction to sequentially reel out the interconnected wire ropes 25, 38 respectively stored thereon, and a second direction to sequentially reel in the interconnected wire ropes; yet, wherein: i) the radial end flanges 42, 44 on the two drums—i.e., the outermost radial flanges 42, 44 on respective ones of the drums 40, 41—and a common central radial flange 45 intermediate the two drums 40, 41, have sufficient structural integrity as to resist the tremendous lateral spreading forces imposed thereon by the wire mooring rope 25 spooled on the drum 40 when the wire rope 25 is under significant tensile loads; and ii), the two wire ropes—i.e., the approximately 3½" diameter wire rope mooring line 25 wound on drum 40 and the approximately 2½" diameter wire rope lanyard 38 wound on drum 41—are maintained, at all times, devoid of bends or kinks, particularly in the region where they are joined to the first inboard connector 24.

Figure 4:
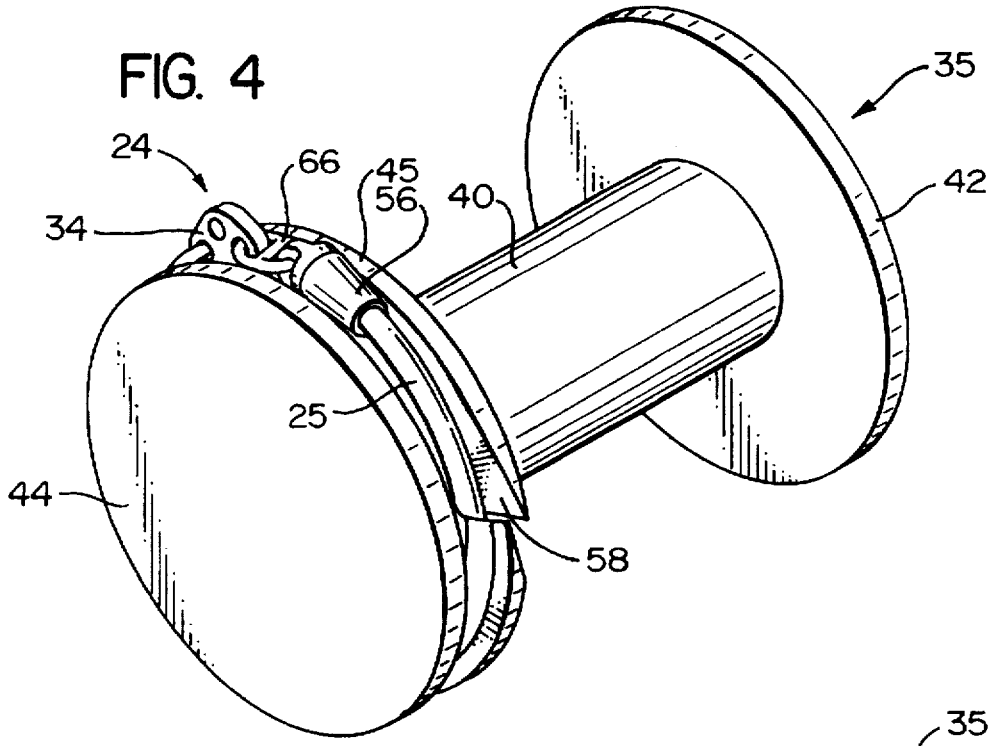
FIG. 4 is a highly simplified isometric drawing here depicting a dual drum or dual storage winch with the wire rope lanyard fully stored on the lanyard drum and the wire rope mooring line angled through the wire support groove in the common drum flange separating the lanyard drum from the mooring line drum.
Figure 5:
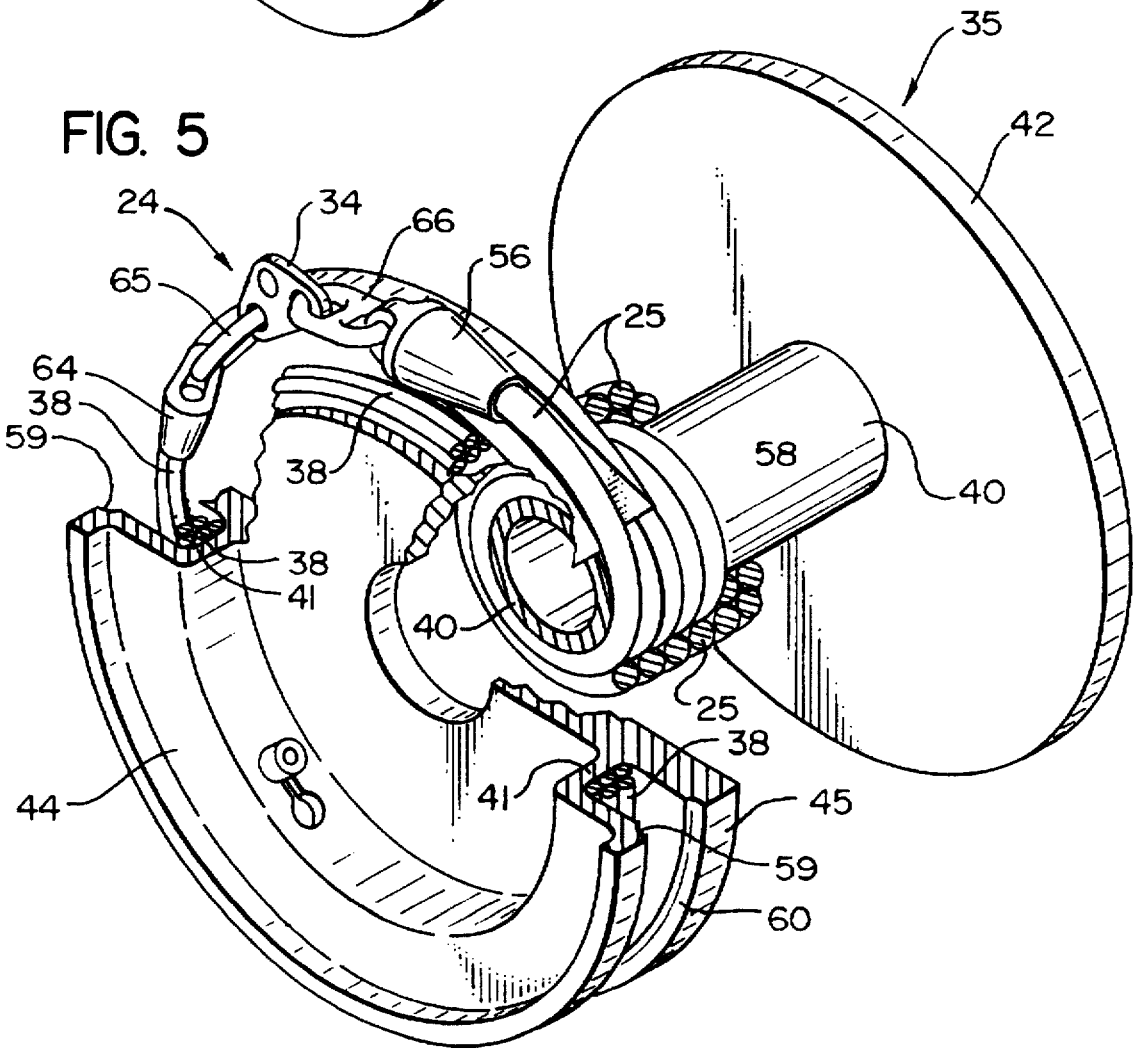
FIG. 5 is a fragmentary, enlarged, diagrammatic isometric view, partially out away and, therefore, partially in section, here depicting the lanyard stored on the lanyard drum and a portion of the mooring line stored on the mooring line storage drum.
Figure 6:
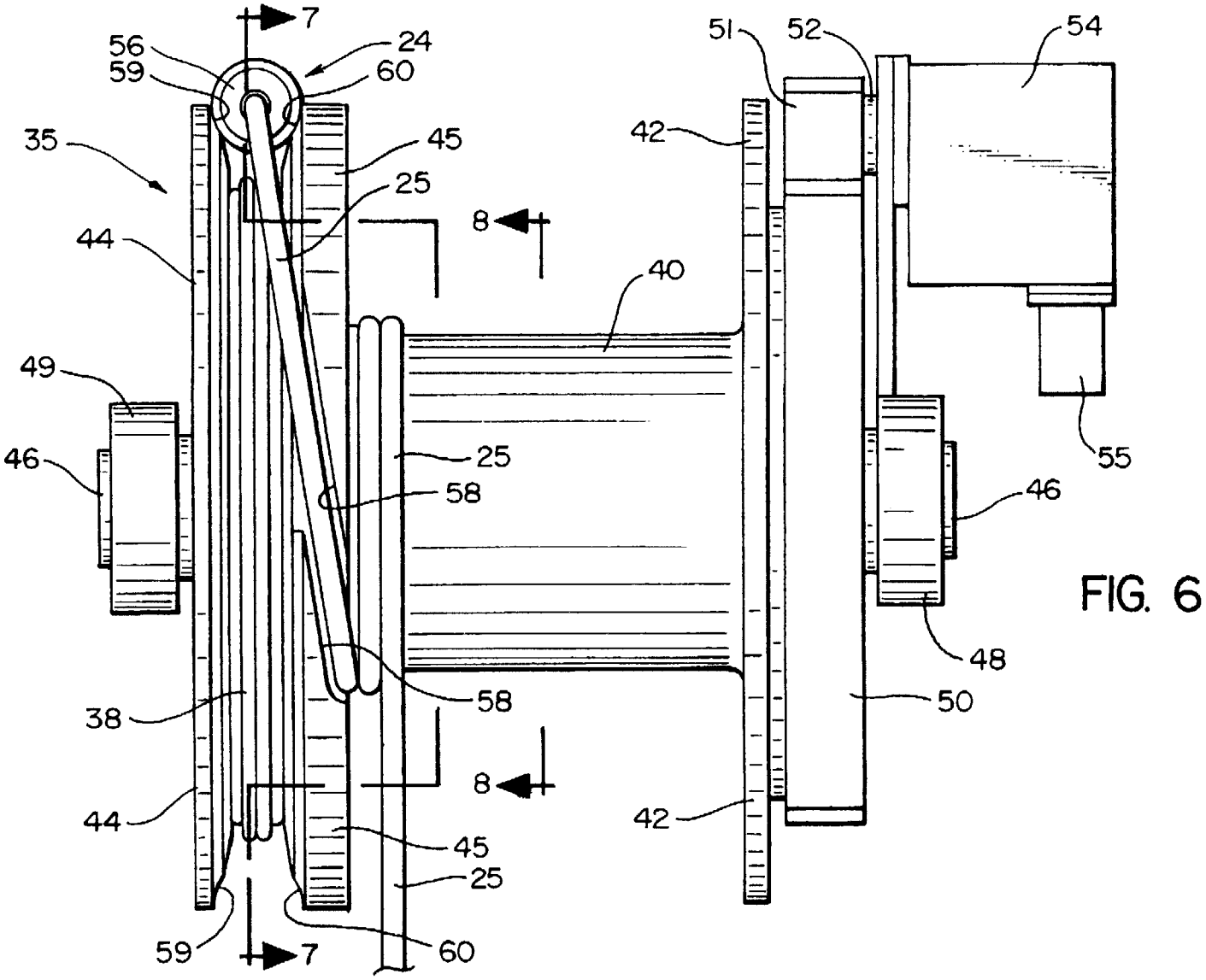
FIG. 6 is a side elevational view of the dual drum or dual storage winch embodying features of the present invention, here illustrating particularly a diagrammatic drive system for rotating composite coaxial side-by-side drums when reeling in and/or reeling out the wire rope lanyard and the wire rope mooring line.

To accomplish this, the exemplary storage winch generally indicated at 35 in FIGS. 2A through 2E and 3A through 3D, but best illustrated in FIGS. 4 through 6, includes: i) a first drum 40 having a drum diameter of approximately 52" and an axial or barrel length of approximately 80" for storing, reeling out and reeling in the approximately 3½" diameter wire mooring rope 25 which may have a length up to approximately 6,000 feet; ii) a second drum 41 having a drum diameter of approximately 110" and an axial length of approximately 15" at the periphery of the flanges 44, 45, and approximately 8" at the barrel of the drum 41 for storing, reeling out and reeling in the approximately 2½" wire rope lanyard 38 which may have a length of approximately 175 feet; iii) a common central radial flange 45 having a thickness of approximately 5" and a diameter of approximately 128", and iv), a pair of outboard end flanges 42, 44 on opposite ends of respective ones of the drums 40, 41 wherein the end flanges 42, 44 are, respectively, approximately 3" and 2½" in thickness with each having a diameter of approximately 128".

While the specific dimensions of the drums 40, 41 and flanges 42, 44, 45 as indicated above have been found to be particularly advantageous when dealing with: i) a wire rope mooring line 25 approximately 3½" in diameter and having a length of approximately 6,000 feet; and ii), a wire rope lanyard 28 approximately 2½" in diameter and approximately 175 feet in length, those skilled in the art will appreciate that such dimensions are not critical to the invention and may be scaled up or down, generally proportionally, dependent upon such variable parameters as the length and thickness of the wire ropes 25, 38 employed.

In carrying out this aspect of the invention, the storage winch 35—including the side-by-side coaxial storage drums 40 (for storing, reeling in and unreeling the wire mooring rope 25) and 41 (for storing, reeling in and unreeling the wire rope lanyard 38)—includes a drive shaft 46, best shown in FIGS. 6 and 7, upon which the drums 40, 41 are non-rotatably mounted with the opposite ends of the drive shaft 46 being rotatably journaled in bearings (not shown) mounted in a pair of spaced apart support pedestals 48, 49 permanently affixed to the deck or other suitable fixed support structure on the drilling platform 20. Rotational drive is imparted to the drive shaft 46 by a bull gear 50 splined or otherwise keyed to the drive shaft, with the bull gear being meshed with a drive pinion 51 mounted on the output shaft 52 of a suitable reversible drive gear box 54 coupled to a reversible hydraulic motor 55 or other suitable source of motive power, all as best shown in FIG. 6. Thus, the arrangement is such that the motor 55 and associated gear train contained in the gear box 54 serve to drive the meshed drive pinion 51 and bull gear 50 in a selected one of opposite rotational directions so as to rotationally drive the drive shaft 46 and coaxial side-by-side drums 40, 41 in a desired rotational direction to either unreel or reel in: i) the wire mooring rope 25 from or onto the drum 40; and/or ii), the wire rope lanyard 38 from or onto the drum 41.

In order to permit the inboard end of the wire mooring rope 25—which is fixedly secured to a spelter socket 56 (best shown in FIGS. 4, 5, 6 and 7) forming part of the inboard connector 24 which is seated on the facing inner peripheral edges of the lanyard drum flanges 44, 45—to smoothly transit from the drum 40 about which the wire mooring rope 25 is wound to the drum 41 about which the wire rope lanyard 33 is wound, the common central flange 45—a flange which, in the exemplary embodiment of the invention, has a thickness of approximately 5"—is provided with a wire rope support groove 58 best shown in FIGS. 4, 5 and 6 that extends from the upper edge of the flange 45 adjacent the flange sidewall facing the wire rope lanyard drum 41 downwardly in a generally tangential direction with respect to the wire mooring rope drum 40, with the wire support groove 58 opening into the drum 40 adjacent the barrel of the drum.

As a consequence of the foregoing construction, the central flange 45 is not cut axially through the flange 45 to the depth of the drum barrel but, rather, the wire support groove 58 extends downwardly at a angle from the lanyard drum 41 (where the groove 58 has a depth approximately equal to the 3½" diameter of the wire mooring rope 25) tangetially towards the mooring rope drum 40 (where the depth of the groove 58 is approximately equal to the radial height of the flange 45 above the barrel of the drum 40). This arrangement ensures that sufficient metal remains in the approximately 5" wide flange 45 in the region of the wire support groove 58 to ensure the structural integrity of the flange 45, thereby enabling the flange 45 to resist the significant lateral spreading forces resulting from approximately 6,000 feet of 3½" diameter wire mooring rope 25 wound about the drum 40 under tension.

Thus, the arrangement is such that during, for example, an unreeling operation, the wire mooring rope 25 is paid out tangentially from the drum 40 until such time that the last winding of mooring rope 25 is unwound from the drum. As the last winding to the mooring rope 25 is unwound from the drum 40, the inboard end of the mooring rope 25, which extends laterally and upwardly through the wire support groove 58 towards the lanyard drum 41, lifts out of the groove 58, thereby enabling the inboard connector 24 and wire rope lanyard 38 to smoothly unreel from the lanyard drum 41 in a tangential direction.

In yet another of its important aspects, and as best shown by reference to FIGS. 5 and 6, the inner peripheral edges of the sides of the flanges 44, 45 on the lanyard drum 41 are concave when viewed normal to the drum axis as indicated at 59, 60 in FIGS. 5 and 6. More specifically, the concave peripheral edges 59, 60 on the flanges 44, 45 respectively lie on a circle having the same diameter as the diameter (approximately 15") of the spherical portion of the spelter socket 56 fixedly attached to the inboard end of the wire mooring rope 25. Therefore, the same degree of support is provided for the spelter socket 56 as is provided by the combination connector depicted in FIGS. 2, 3 and 4 of the aforesaid Wudtke U.S. Pat. No. 3,842,776. This arrangement prevents the wire mooring rope 25 from kinking and/or bending at its juncture with the spelter socket 56. In the alternative modification of an anchoring system as described in connection with FIGS. 3A through 3D, the combination connector 24 is arranged to cooperate with a column mounted combination fairlead sheave 31 as shown in FIGS. 2 through 4 of the aforesaid Wudtke U.S. Pat. No. 3,842,776, again ensuring that the wire mooring rope 25 does not kink or bend at its juncture with the spelter socket 56 when the first inboard connector 24 transits the fairlead sheave 31 during either an anchor deployment operation or an anchor retrieval operation.

In order to assemble the wire rope lanyard 38 on the lanyard drum 41, the inboard end of the lanyard 38 is passed through a bore 61 in the barrel of the drum as best shown in FIG. 7; and, is secured in place by a cable clamp or anchor 62, thereby firmly anchoring the inboard end of the lanyard 38 to the drum 41 and, therefore, to the support structure of the drilling platform 20 upon which the storage winch 35 is mounted. The lanyard 38 is then wrapped about the drum 41—in the exemplary construction, through five full turns—with the outboard end of the lanyard 38 being permanently anchored in a wire rope fitting 64. The wire rope fitting 64 is, in turn, separably coupled to one eye of the 3-eye link 34 by a clevis 65. The spelter socket 56 permanently affixed to the inboard end of the wire mooring rope 25 is separably coupled to a second eye on the 3-eye link 34 by a detachable connector link 66. The inboard end of the wire mooring rope 25 is then fed through the wire support groove 58 in the common central flange 45, exiting therefrom tangentially with respect to the barrel of the wire rope mooring drum 40, with the wire mooring rope 25 being wrapped around the drum 40.

As a consequence of the foregoing construction, during an unreeling operation when the anchor 21 (FIGS. 1 through 2E or FIGS. 1 and 3A through 30) is being deployed, the hydraulic motor 55 (FIG. 6) or other suitable source of motive power is actuated to rotationally drive the drum shaft 46 in a clockwise direction as viewed in FIG. 7 (counter clockwise as viewed in FIG. 8) so as to unreel the wire mooring rope 25 tangentially from the drum 40 on the storage winch 35. When the last turn of the wire mooring rope 25 on the drum 40 is unreeled, the inboard end of the wire mooring rope 25, which passes laterally and upwardly through the wire support groove 58 in the central flange 45, lifts out of the wire support groove 58; and, continued clockwise motion of the drum shaft 46 (as viewed in FIG. 7) serves to unreel the first inboard connector 24 and the wire rope lanyard 38 tangentially from the lanyard drum 41. The foregoing arrangement ensures that as the wire rope mooring line 25 is unreeled (as well as during a reeling operation when the anchor 21 is being retrieved), its inboard end, which is anchored in the spelter socket 56, is prevented from kinking and/or bending, thereby maintaining the structural integrity of the wire mnooring rope 25 under all operating conditions.

I claim:

1. A storage winch for use in deploying and retrieving an anchor employed in auxiliary mobile offshore drilling platforms and the like, said storage winch comprising, in combination:

a) a pair of spaced apart pedestals adapted to be fixedly mounted on the drilling platform;

b) a drive shaft journaled for rotation in said pair of support pedestals;

c) first and second coaxial side-by-side storage drums non-rotatably mounted on said drive shaft;

i) said first storage drum comprising a wire mooring rope storage drum having a drum barrel with a diameter $D_1$ and an uninterrupted axial length $L_1$;

ii) said second storage drum comprising a wire rope lanyard storage drum having a drum barrel with a diameter $D_2$, where $D_2$ is substantially greater than $D_1$, and an uninterrupted axial length $L_2$, where $L_2$ is substantially less than $L_1$;

iii) a common central circular flange integral with and intermediate said first and second side-by-side storage drums, said common central circular flange having a diameter $D_3$ substantially greater than $D_2$ and an axial thickness $T_1$;

iv) a first circular end flange integral with said first storage drum and disposed on the end of said first storage drum remaote from said common central circular flange, said first end flange having a thickness $T_2$ and a diameter substantially equal to $D_3$;

v) a second circular end flange integral with said second storage drum and disposed on the end of said second storage drum remote from said common central circular flange, said second circular end flange having a thickness $T_3$ and a diameter substantially equal to $D_3$;

d) said commmon central circular flange having a first sidewall facing said first storage drum and a second sidewall facing said second storage drum;

e) a wire support groove formed in said common central circular flange extending from said second sidewall adjacent the outer peripheral edge of said central circular flange toward said first storage drum and generally tangential with respect thereto, said wire support groove exiting said first sidewall adjacent said first storage drum; and, f) means for rotatably driving said drive shaft in a selected one of first and second directions for reeling wire rope onto said first and second coaxial side-by-side drums when said shaft is rotated in said first direction and for unreeling wire rope from said first and second coaxial side-by-side drums when said shaft is rotated in said second direction.

2. A storage winch as set forth in claim 1 further including:

g) a wire rope lanyard having inboard and outboard ends with said inboard end projecting through and being secured to said second drum, said wire rope lanyard adapted to be wound about, stored on, unreeled from and reeled onto said second storage drum;

h) a wire mooring rope having inboard and outboard ends with said inboard end of said wire mooring rope projecting through said wire support groove and terminating on said second storage drum adjacent said outboard end of said wire rope lanyard, said wire mooring rope adapted to be wound about, stored on, unreeled from and reeled onto said first storage drum;

i) a connector assembly for separably coupling said inboard end of said wire mooring rope to said outboard end of said wire rope lanyard, said coupling assembly including a 3-eye link, a spelter socket fixedly secured to said inboard end of said wire mooring rope, a detachable connecting link coupled to said spelter socket and separably coupled to said 3-eye link, a wire rope fitting fixedly secured to said outboard end of said wire rope lanyard, and a clevis coupled to said wire rope fitting and separably coupled to said 3-eye link, said spelter socket including a spherical portion positioned to abut the inwardly facing peripheral edges of said common central circular flange and said second circular flange and to be supported thereby.

3. A storage winch assembly as set forth in claim 2 wherein said inwardly facing peripheral edges of said common central circular flange and said second circular flange are concave having a circular shape complemental to said spherical portion of said spelter socket.

4. A storage winch as set forth in claim 1 wherein said first wire mooring rope storage drum is dimensioned so as to permit stowage thereon of a wire rope mooring line having a diameter of approximately 3½" and a length up to approximately 6,000 feet.

5. A storage winch as set forth in claim 4 wherein said second wire rope lanyard storage drum is dimensioned to permit stowage thereon of a wire rope lanyard having a diameter of approximately 2½" and a length of approximately 175 feet.

6. A storage winch as set forth in claim 5 wherein $D_1$ is approximately 52"; $D_2$ is approximately 110", $D_3$ is approximately 128", $L_1$ is approximately 80", $L_2$ is approximately 5", $T_1$ is approximately 5", $T_2$ is approximately 3" and $T_3$ is approximately 2½".

7. A storage winch as set forth in claim 1 wherein said second wire rope lanyard storage drum is dimensioned to permit stowage thereon of a wire rope lanyard having a diameter of approximately 2½" and a length of approximately 175 feet.

* * * * *